United States Patent [19]

Lawrence

[11] 4,114,974

[45] Sep. 19, 1978

[54] DUST SHIELD FOR CAP AND CONNECTOR

[75] Inventor: George J. Lawrence, North Kingston, R.I.

[73] Assignee: General Electric Company, New York, N.Y.

[21] Appl. No.: 828,580

[22] Filed: Aug. 29, 1977

[51] Int. Cl.[2] ..... H01R 13/58

[52] U.S. Cl. ..... 339/103 C; 339/60 C; 339/94 C

[58] Field of Search ..... 339/103 C, 103 R, 103 B, 339/60 R, 60 C, 94 R, 94 L, 94 C, 60 M

[56] References Cited

U.S. PATENT DOCUMENTS

| | | | |
|---|---|---|---|
| 2,409,732 | 10/1946 | Browne et al. | 339/94 C X |
| 2,642,474 | 6/1953 | Bowar | 339/60 C X |
| 3,601,761 | 8/1971 | Harris | 339/103 C X |
| 4,070,085 | 1/1978 | Nelson | 339/103 C X |

*Primary Examiner*—Roy Lake
*Assistant Examiner*—DeWalden W. Jones
*Attorney, Agent, or Firm*—Paul E. Rochford; F. L. Neuhauser

[57] ABSTRACT

A seal for a cable connector is provided. The seal is made between a cable extending into an oversize cable clamp housing and the housing itself. The sealing element itself is a generally annular ring of yieldable material such as polymer foam. The sealing element preferably includes three generally triangular sectors some surfaces of which are preferably curved and the sectors are interconnected by webs formed integrally with the sectors. The annular sealing element extends generally about a cable extending into the housing.

7 Claims, 8 Drawing Figures

DUST SHIELD FOR CAP AND CONNECTOR

BACKGROUND OF THE INVENTION

The present invention relates to cable terminals in general and to caps and connectors which are fitted to the ends of cables to provide for temporary supply of electricity through such cables by connecting plugs and connectors with various receptacles and equipment for use of the electricity.

It is well known that cables are employed in numerous applications outside of building wire conduits and that such cables are frequently employed for the temporary supply of electricity to equipment. The temporary supply may be of a long term nature and the environment in which the cable and the connectors attached to the cables are used can be heavy industrial environments such as machine shops, mines and factories where cable is subject to becoming coated with dirt and machine chips and other contaminants of the enviroment which are normally and necessarily present in such use locations. Where certain types of environmental contaminants such as metallic dust and metallic grindings and chips and cuttings are present, it is possible for these substances to enter into the caps and connectors attached to cables to contaminate the interior of the caps and connectors. In some cases, if some solid or fluid material enters the cap or connector, it may form an electrical bridge between conducting metal portions within the cap or connector and may lead to a current leakage within the cap or connector which is undesirable or dangerous. Alternatively, metal contaminants in a connector forming such a bridge may lead to a shorting of the current carrying elements and to a destruction of the cap or connector. Accordingly care should be employed in use of caps and connectors in such environments and boots may be employed to keep moisture and contaminants from such connectors to reduce the problems mentioned above which may be associated with use of such caps and connectors.

It is also known that it is desirable in providing caps and connectors for attachment to electric cables that the cap and connector be capable of receiving a wide range of cable sizes. For example, an insulative cable which has three conductors of No. 12 AWG and which can carry 600 volts may have an outer insulation diameter of ⅝ inch. Such wire grip is taught in U.S. Pat. Nos. 3,984,168 and 3,989,340 assigned to the same assignee as the subject application. Other cables may have substantially smaller diameters.

While the occurrence of the contamination of the interior of such a cap and connector is related to the actual size of wire which is held within the wire clamp of the connector and the environment in which the connector is employed, it is nevertheless apparent that where it is feasible to do so, it is desirable to seal the entrance to the connector, and particularly to seal the region around the cable where smaller diameter cables are employed. Accordingly, if smaller diameter cables are to be employed in such a connector in an environment where high levels of contaminants are present, then it is desirable to have a closure for the connector or cap which is an alternative to an outer boot and which is nevertheless effective in keeping those contaminants from the interior of the cap or connector such effectiveness is related to closing a gap between the wide cable opening of the connector and the narrow cable extending through this opening in the absence of a coverall-type boot.

OBJECTS OF THE INVENTION

It is accordingly one object of the present invention to provide a seal for a cap or connector which prevents the entry of foreign material into the cap or connector.

Another object is to provide a sealing element which effectively seals a connector against entry of foreign material at a relatively low cost.

Another object is to provide a connector having a seal for prevention or limitation of entry of foreign material thereinto.

Still another object of the present invention is to provide a cap and connector which in the connected state can be used in industrial atmospheres with a substantially reduced danger of shorting between the electrical elements within the connected cap and connector due to entry thereinto of dilatorious foreign matter.

Other objects will be in part apparent and in part pointed out in the description which follows.

In one of its broader aspects, objects of this invention are achieved by providing a sealing element for a cable connector. Such a seal is employed in a connector between a cable extending into a cable opening of the connector and the opening itself and may cooperate with elements of the cable clamp within the housing of the connector. The sealing element itself is generally of ring form although not a simple ring in shape. The sealing element is composed of a resilient material having a plurality of wedge-shaped elements around the ring with the apex of the wedges facing generally toward the center of the ring. Some of the outer surfaces of the wedges are preferably rounded to enhance the seal formed as the clamp is brought to bear against and grip the cable. Webs or connecting arms of the same resilient material extend between the wedges and form with the wedges the ring which constitutes a sealing element.

BRIEF DESCRIPTION OF THE DRAWINGS

The invention described herein will be understood with greater clarity by reference to the accompanying drawings in which.

DESCRIPTION OF THE PREFERRED EMBODIMENT

The sealing element which is provided pursuant to this invention is one which provides a seal against entry of foreign material into a cap or connector at the end of the cap or connector through which the cable enters. As pointed out above, one problem in the use of caps and connectors is that they must be made to accommodate a wide range of cable sizes and in order to do so, the opening which admits the cable to the connector must be of larger dimensions. However, where the actual cable entering the connector is of smaller dimension, then gaps and openings can be left between the outer surface of the entering cable and the inner surface of the cable port of the connector. The use of caps and connectors in industrial atmosphere can result over a period of time in entry of foreign material and accumulation of such material within the connector.

Figure 1:
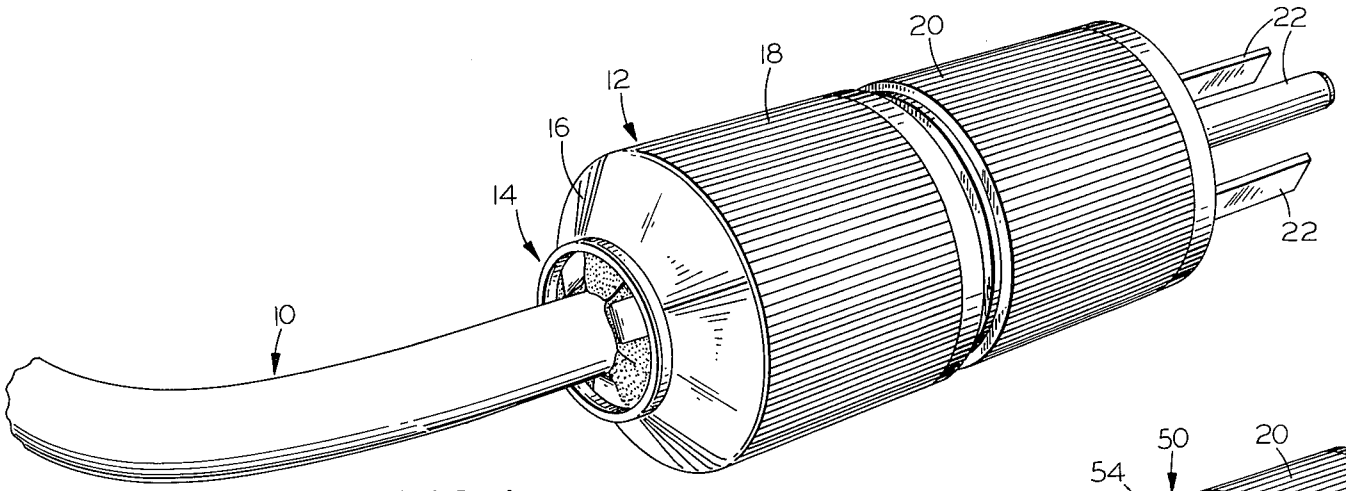
FIG. 1 is a perspective view of a connector as provided pursuant to the present invention, showing the cable port and cable extending into the port and showing the sealing element located at portions of the opening between the port interior and cable exterior.

A connector as used in this application is meant to include both a plug or cap having outwardly extending metal blades as illustrated in FIG. 1 of the drawings, as well as a connector in the sense of a device having blade receptacles in its face so that contact can be made between male blades as shown in the plug or cap of FIG. 1 and female contacts within the insulating housing of the connector. The term connector itself sometimes creates confusion in that in a more technical sense it is meant to refer to the female member of the connector and plug family, but it has acquired a usage of a more generic sense and it is in this sense that it is used in this application to include both the plugs having extending blades and the connector receptables having internal contact for blades extending thereinto through blade entry openings in its outer face.

In any case, the seal of the present invention is equally applicable to both caps and connectors and there is no difference in its function at the cable entrance and cable clamping portion of the device in providing a desirable seal between the outer surface of the cable and the inner surface of the housing and cable entry port. In FIG. 1, the cable itself 10 enters a housing 12 at a port 14 characterized in the particular illustration of FIG. 1 as having a relatively smaller diameter cable in relation to the inner diameter of the receiving cable port 14. The housing 12 may be made up of a tapered rear surface 16 and a tubular insulating housing 18 integral with the tapered end 16. Port 14 and tubes 18 and 20 form parts of the housing of the plug connector of FIG. 1. The second tubular housing 20 is mechanically linked to the first tubular housing 18 through a screw mechanism illustrated in FIG. 2. The blades 22 extending from the opposite end of the connector are of the conventional variety and may be any configuration of blades conventionally employed in temporary supply of electrical power through cables such as 10.

Figure 2:
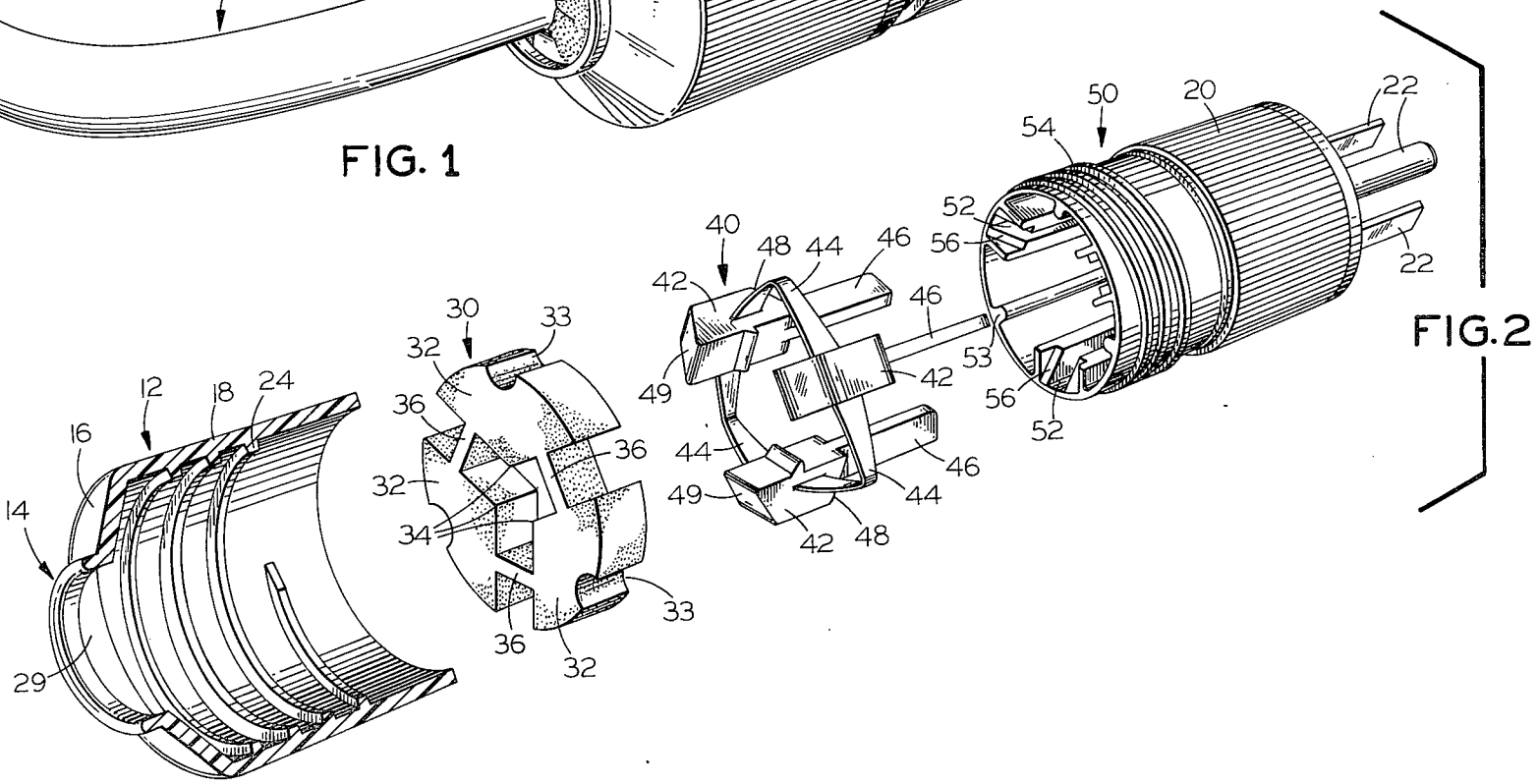
FIG. 2 is a perspective exploded view illustrating the sealing element in relation to the other parts of the connector with which it is associated.

With particular reference now to FIG. 2, an exploded perspective view of elements of the present invention are shown including the tubular housing 18 having internal threads 24.

Figure 3:
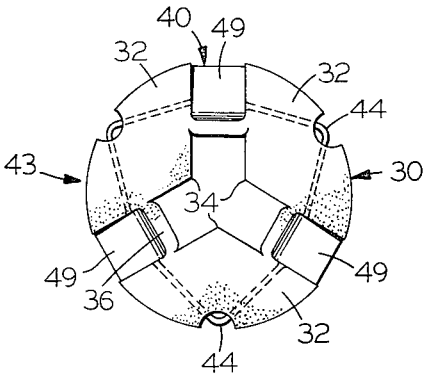
FIG. 3 is a top plan view showing the sealing element in relation to an internal double wedge clamping element of the connector.

The disassembled parts of the connector clamp mechanism include the rear housing 12, the seal element 30, the clamp element 40 and the forward housing 50. In the first step of assembly of these items, the seal 30 may be placed on the clamp 40 to achieve the alignment of these parts as illustrated in FIG. 3. The seal element 30 has a number of wedge or pie-shaped sectors 32 which have their respective apexes 34 facing toward the center of the generally ring-shaped seal element 30. The apexes 34 or other portions of the sectors may be curved as appropriate to achieve good sealing of the cable entrance 14 after assembly of the elements. The sectors 32 are connected by the interconnecting webs 36 so that the combination of the webs 36 and the sectors 32 form a generally ring-like structure extending about a hollow center through which a cable may be passed.

As evidenced by comparison with FIG. 1, the cable first passes through the cable port 14 of rear housing 12 and it then passes through the opening in the seal element 30, then through the opening in the clamp element 40 and into the forward housing 50. The bared ends of individual conductors of the cable are connected respectively to the internal ends of blades 22 or to similar contacts of a receptacle unit (not shown). The actual manner of connection of the wires to contacts is not part of this invention but is described and illustrated in other patents, such as U.S. Pat. No. 3,984,168 referred to above.

The construction and operation of the clamp element 40 relative to the housing is also described and illustrated in the U.S. Pat. Nos. 3,984,168 and 3,989,340 referred to above and assigned to the same assignee as the present invention. The clamping element 40 is characterized in this instance by three symmetrically placed double wedge cleats 42 formed integrally with an interconnecting web 44 and with downwardly extending guides 46.

When the clamping element is first assembled to the housing 50, the guides 46 are inserted in the guideways 52. These guides 46 are held within the guideways 52. As the rear cover 12 is threaded onto the forward housing 50 the internal threads 24 of rear tube housing 18 and the external threads 54 of the forward housing 50 intermesh to produce an axial movement of the frong and rear tubes 50 and 18 respectively responsive to a relative rotary motion of these two parts. The beveled surface 48 of the double wedge cleats 42 ride on the ramps 56 on either side of the guideways 52. Similarly, the rear beveled surfaces 49 ride on the internal beveled surface 29 so that the double wedge cleats 42 are forced inwardly in the manner illustrated by comparison of FIGS. 4 and 5 of the drawings. In these Figures the surfaces 49 are shown in a top plan view or a rear plan view, taken from the rear of the device and prior to the inclusion of a cable in the device.

As is evident from FIG. 2, the seal element 30 has the additional notches 33 which facilitate the entry of the element into the housing 50 about the ribs 53 and which serve as focal points for the compression of the three tapered sectors 32 as the clamping or gripping element 40 is closed by interaction of the respective internal and external threads of the two housings 18 and 53.

The configuration of the seal element 30 with reference to the clamp element 40 and the housing 50 may thus be described as a complementary configuration. This use of complementary is intended in the geometric sense as indicating two smaller angles which fit neatly and precisely together to form a larger angle. In other words, the shape of the seal 30 is one which is made up of elements such as the sectors and interconnecting webs such that the seal is present at locations where other elements are absent from the clamp element and from the housing 50. Of course, the center of the seal element is open just as the center of the clamp element is open to admit a wire of appropriately large or small size.

In this connection, it should be pointed out that one feature of the clamp mechanism of the U.S. Pat. Nos. 3,984,168 and 3,989,340 is that it accepts or accommodates a large range and variety of cable diameters and shapes. Very similarly, the seal of this invention also is usable and effective with a large variety of cable diameters and shapes. Accordingly, where the cable is of the maximum diameter and almost fills the cable port 14, the seal is quite effective in sealing the narrower opening between the exterior surface of the cable and the interior surface of the port 14. Conversely, when the cable size is quite small in relation to the cable port, the sealing element is nevertheless very effective in providing an effective sealing and closure of all of the openings between the cable external surface and cable port internal surface.

Some of the relationships between the various elements of the seal discussed above are made evident by reference to the FIGS. 6, 7 and 8 for actual use or operation conditions.

Figure 8:
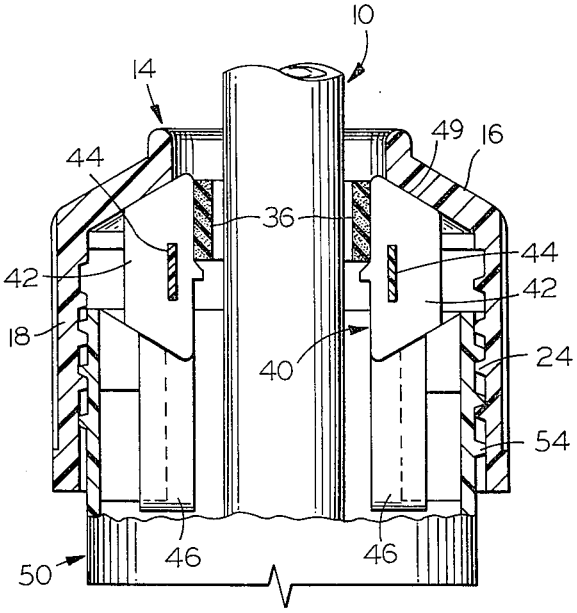
FIG. 8 is a sectional view taken along the line 8—8 of FIG. 4 illustrating the relationship between the sealing element, the cable clamp and a cable but prior to the compression of the cable clamp about the cable passing through the insulating housing and the compression of the seal element against the cable exterior.

Referring further to FIG. 8, the elements discussed above are illustrated and the interaction of the seal element in the structure is more readily evident. The section shown in FIG. 8 is similar to the section shown in FIG. 6 in the sense that in both Figures the web 44 of the clamp element is seen in section and the web 36 and it will be noted that the section of FIG. 6 is similar to one taken along the lines 8—8 of FIG. 4.

Accordingly, the structure of FIG. 8 includes the cable 10 extending through the housings from the cable port 14, in this illustration shown in the reverse position to that shown in FIGS. 1 and 2. The beveled surface 16 of the outer and rear housing 18 is shown at its internal surface in contact with a beveled surface 49 of the double wedge cleat 42. The rear housing 18 is engaged on its internal threaded surface at threads 24 with the external threads 54 of the housing 50. By turning housing 18 relative to the housing 50, the engaged threads cause an axial movement of the housing 18 toward housing 50 and cause a wedging action on its double wedge cleat 42 to urge the cleat inward against the web 36 of the seal element 30 and to urge the cleat into contact with the external surface of cable 10. It will be noted that the web 36 is spaced from the external surface of the cable both above and below the cable inasmuch as FIG. 8 illustrates the parts in the pre-compressed condition.

Figure 6:
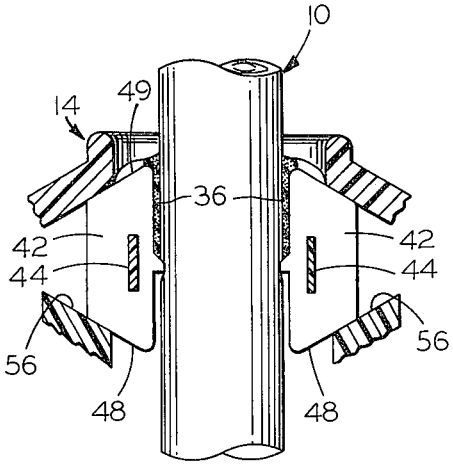
FIG. 6 is a sectional view illustrating the relationship between the sealing element, the cable clamp and a cable within the insulating housing.

Considering next FIG. 6, the arrangement of parts illustrated in FIG. 8 is shown again but in this case, the compression has been accomplished by rotation of housing 18 relative to housing 50 to permit the threads 24 and 54 to engage and in turn to permit the double cam surfaces to operate against their respective beveled surfaces and force cleats 42 inward toward the cable. Cleat 42 of FIG. 6 is illustrated as being in contact at a toothed surface with the exterior surface of cable 10. As is also evident from FIG. 6, the seal 36 is compressed by cleat 42 between the inner surface of the cleat and the outer surface of cable 10. Web 44 is evident both above and below the cable illustrating that the section shown is essentially the section taken along the line 8—8 of FIG. 4. Accordingly, it is clear from FIG. 6 that the seal element effectively provides a seal of any possible openings between the external surface of cable 10 and the internal surface of cleats 42.

Figure 5:
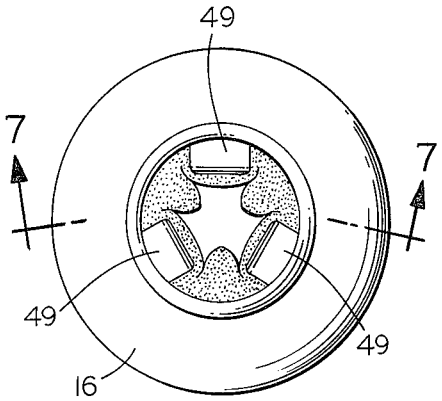
FIG. 5 is a view similar to that of FIG. 4 but with the internal clamping structure moved toward the center of the housing and illustrating the corresponding movement of the sealing element.
Figure 7:
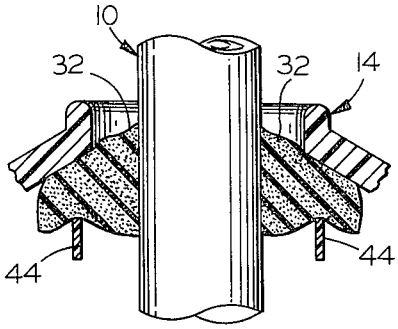
FIG. 7 is a sectional view taken along the line 7—7 of FIG. 5 illustrating a part of the insulating housing with a cable in place in the cable port and the insulation element pressing against the internal surface of the port and the external surface of the cable.

Turning next to FIG. 7, the FIG. 7 is similar to that of FIG. 6 with the exception that the viewing is through a different angle and, in particular, is in a view taken along the line 7—7 of FIG. 5. In this view, the seal element 32 extends from the external surface of cable 10 to the internal surface of cable port 14 and, although the seal element is itself somewhat compressed in this relationship, it nevertheless provides an effective closure of the opening between the interior of port 14 and the external surface of cable 10. Please note the extent of the portion of the seal element described above as being wedge-shaped or pie-shaped sectors which exist in both the upper and lower portions of FIG. 7. The two strips 44 above and below cable 10 are the webs which connect the spaced cleats of the clamping element 40 as illustrated in FIGS. 2 and 3.

Figure 4:
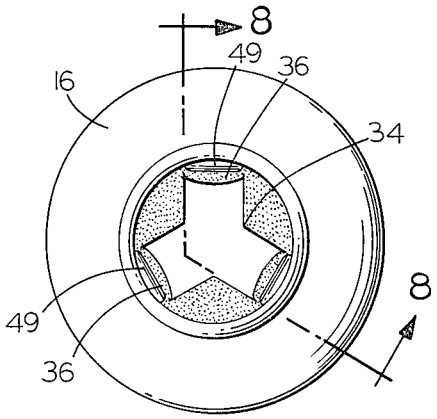
FIG. 4 is a top plan view of the rear of a connector illustrating the insulating housing with its central cable port and illustrating the sealing element in the form illustrated in FIG. 3 located within the housing.

The distinct advantages of the structure of this invention are evident from the foregoing description and figures. It is readily apparent that one of the principal advantages is that there is a very effective closure of the opening about a cable which is situated in a cable port of a connector and that this effective closure is produced in spite of the widely varying size of opening and irregular shape of opening to be sealed. Also this effective closure is produced at a very low cost both in materials and in labor. As a matter of fact, the elements shown in FIG. 2 in exploded form need not be opened at all but rather the cable can be threaded through these elements when they are in an assembled form. Thus, the cable can be threaded through for example, by deflection of the inwardly extending sector angles 34 as illustrated in FIG. 4. Also the seal can be generated about the introduced cable whether the cable is of only a small diameter of the order of a quarter of an inch or whether it is of a much larger diameter of the order of five eighths of an inch or approaching the size of the port 14 for a smaller version of these caps and connectors. It is, of course, apparent that where larger caps and connectors are employed and larger cables are held within such caps and connectors that the size of cable will be different from that given in the illustrative example. However, there will be no departure from the spirit and scope of the present invention in using a combination of resilient seal element 30 together with the clamp element 40 where such elements are held within the housings 18 and 50 and where cable is introduced through the cable port, clamped into place, and an automatic and low cost of the interior of the connector from its exterior environment is accomplished.

It is further readily evident that if the number of sectors 32 which are employed in a particular cap or connector is increased to four or five or reduced to two that the same combination of parts may be employed successfully in achieving a desired seal about the cable entering the wiring device through such a cable port.

What is claimed and sought to be protected by Letters Patents of the United States is:

1. A closure for a cable entrance to a connector comprising, an annual ring of resilient material, said ring being made up of a plurality of wedge-shaped sectors, said sectors being interconnected by a plurality of webs formed integrally with said wedge-shaped sectors, the inner extent of the sectors being oriented generally toward the center of the annual ring.

2. The seal of claim 1 wherein the outer surface of the wedge-shaped sectors are generally arc shaped.

3. The seal of claim 1 wherein the midback portion of the wedge-shaped sectors are scalloped to aid compressibility.

4. A connector with a dust seal comprising, a connector having an insulating wire attachment body and an outer cord clamp housing extending at least partially about said body, said cord clamp housing including a cord port for entry of a cord into said housing and a cord clamp mechanism internal of said housing, said clamp mechanism being capable of clamping cords of a wide variety of sizes, a resilient seal element located between the cord clamp and the cord port of said housing, said resilient seal element having a generally annular form with the cord extending through the center of the element, and the element being shaped to complement the form of the cord clamp and fill open spaces between the cord clamp and cord port.

5. The connector of claim 4 wherein the cord clamp includes a plurality of ramped cleats.

6. The connector of claim 4 wherein the cord port moves axially relative to the cord as the cord is clamped in said housing.

7. The connector of claim 4 wherein the seal element is shaped to complement the shape of the clamping element within the housing.

* * * * *